United States Patent [19]

Cline

[11] 4,425,704

[45] Jan. 17, 1984

[54] EXTRACTION TOOL FOR ELECTRICAL CONNECTOR LATCH

[75] Inventor: Charles D. Cline, Dallas, Tex.

[73] Assignee: Rockwell International Corporation, El Segundo, Calif.

[21] Appl. No.: 327,004

[22] Filed: Dec. 3, 1981

[51] Int. Cl.[3] ..... H01R 43/00

[52] U.S. Cl. ..... 29/764; 29/235; 29/426.6

[58] Field of Search ..... 29/764, 235, 426.6

[56] References Cited

U.S. PATENT DOCUMENTS

| | | | |
|---|---|---|---|
| 3,087,235 | 4/1963 | Porter | 29/764 |
| 3,570,096 | 3/1971 | Sosinski | 29/764 |
| 4,290,193 | 9/1981 | Anderton et al. | 29/764 |

*Primary Examiner*—Carl E. Hall

*Attorney, Agent, or Firm*—Michael E. Taken; V. Lawrence Sewell; Howard R. Greenberg

[57] ABSTRACT

An extraction tool is provided for removing a locking latch from a snap-in socket of an electrical connector housing. The tool has a fork-like portion insertable into the socket for spreading the latter, and has an extendable hook portion for engaging and removing the latch from the connector housing upon spreading of the socket.

1 Claim, 3 Drawing Figures

EXTRACTION TOOL FOR ELECTRICAL CONNECTOR LATCH

TECHNICAL FIELD

The invention relates to electrical connectors, and more particularly to an extraction tool for removing a locking latch from a snap-in socket of an electrical connector housing.

BACKGROUND AND SUMMARY

Multiconductor flat ribbon cable is typically interfaced to a printed circuit board by an electrical connector having an elongated housing with two rows of pins. The bottom ends of the pins are pushed into the printed circuit board, and the top ends of the pins extend upwardly within the connector housing to receive a mating connector on the flat ribbon cable. The connector housing acts as a receptacle or header for the mating cable connector. The connector housing has a locking latch for holding the cable connector in locked inserted position within the connector receptacle housing. The latch is mounted in a snap-in socket of the connector housing by means of trunnions journaled in apertures in channel walls between which the latch pivots to locking and unlocking positions.

The latch is assembled to the connector housing by pushing the latch into the channel. The trunnions spread the walls of the channel until the trunnions snap into their receiving apertures. There are different length latches for different receptacles and various applications. If the wrong latch is installed, it must be removed without damaging the connector housing. Also, a damaged latch may need replacing.

There exists a need for the capability of removing the latch without damage. Though not limited thereto, the present invention addresses and solves this need.

DETAILED DESCRIPTION

Figure 1:
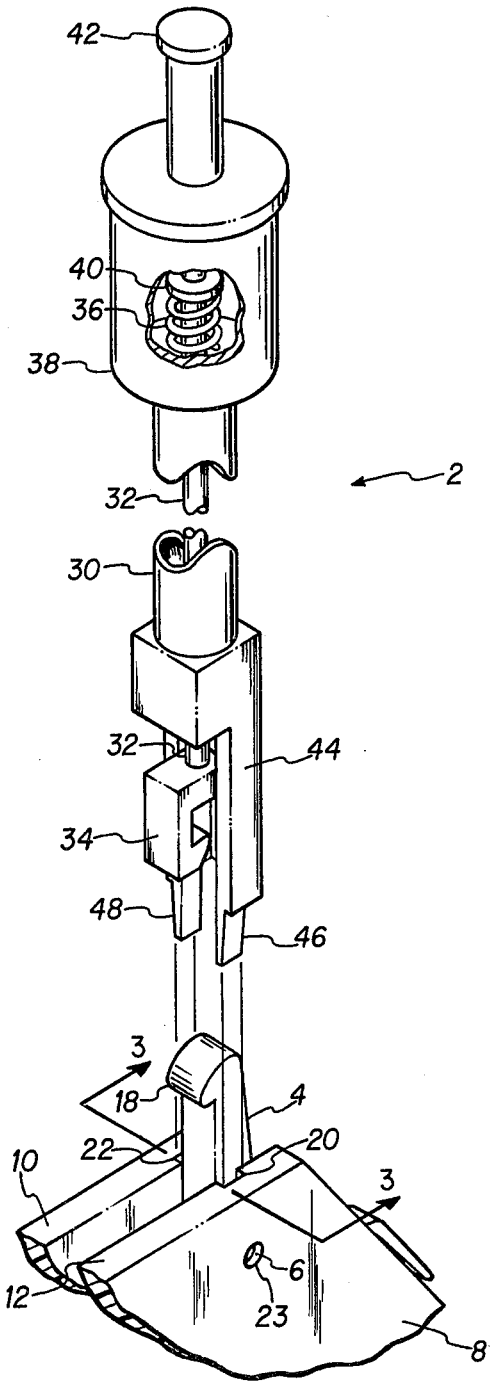
FIG. 1 is a schematic isometric view of an extraction tool constructed in accordance with the invention, and shows a portion of an electrical connector housing.

FIG. 1 shows an extraction tool 2 for removing a locking latch 4 from a snap-in socket 6 of an electrical connector housing 8. In the exemplary embodiment, the electrical connector is an AMP latch receptacle universal ejection style pin header connector, the latch 4 being Part No. 102185, and the connector housing 8 being Part No. 102154, as shown in AMP Product Brochure 4416-8A-7.5M-RB-2-79(CRM), Amp, Inc., Harrisburg, Pa.

Connector housing 8 has a left end (not shown) comparable to the right end shown in FIG. 1. Two rows of pins extend downwardly from housing 8 for insertion into a printed circuit board. The pins extend upwardly and are disposed between longitudinal housing walls 10 and 12 for receiving a mating connector plug from a multiconductor flat ribbon cable or the like. Latch 4 pivots about trunnions 14 and 16, FIG. 3, between locking and nonlocking positions. In the locking position, the upper lip portion 18 of latch 4 engages the mating connector plug of the flat ribbon cable to retain the latter in engaged inserted position in housing 8 between walls 10 and 12. Latch 4 is pivoted clockwise, FIG. 1, to an unlocking position to release the connector plug of the flat ribbon cable. Handle portion 5, FIG. 2, is pushed downwardly by the user, and flange portion 7 in turn pushes the cable connector plug upwardly to eject the latter.

Figure 3:
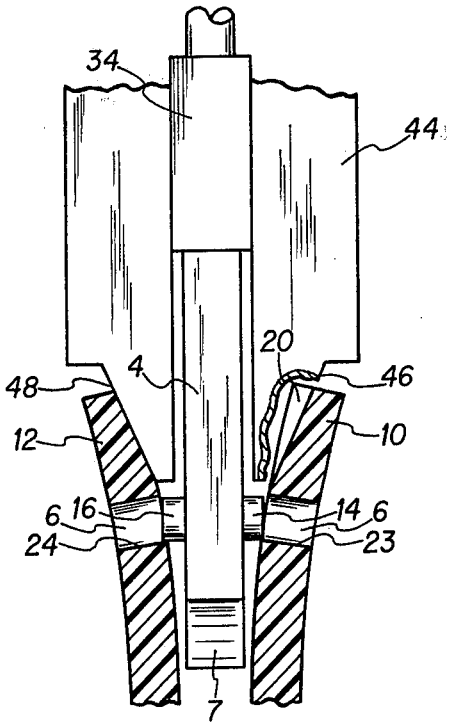
FIG. 3 is a cross-sectional view taken along line 3—3 of FIG. 1 showing tool insertion.

Housing walls 10 and 12 have respective channels 20 and 22, FIG. 1, formed therein. At the bottom of channel walls 20 and 22 are apertures 23 and 24, FIGS. 1 and 3, providing snap-in socket 6 for receiving trunnions 14 and 16. Latch 4 is assembled into housing 8 by inserting the latch between housing walls 10 and 12, with trunnions 14 and 16 sliding down channels 20 and 22, the latter being inwardly tapered from top to bottom as shown in FIG. 3. During this insertion of latch 4, the housing sidewalls 10 and 12 are spread slightly as trunnions 14 and 16 slide further downwardly along the walls of channels 20 and 22 until trunnions 14 and 16 reach apertures 23 and 24, FIG. 3, at which time the housing walls 10 and 12 snap back towards each other in snap-in socket fashion to secure latch 4.

Extraction tool 2 comprises an elongated tool body member 30 having a spring loaded plunger 32 therein with a hook portion 34 at the end thereof. A biasing spring 36 bears at its lower end against a canister 38 at the top of tool body 30 and bears at its upper end against a retaining washer 40 fixedly secured to plunger 32. The top 42 of plunger 32 is engaged by the thumb of the user and depressed while holding canister 38, thus sliding plunger 32 downwardly and compressing spring 36. At the bottom of tool body 30 is a fork-like portion 44 having a pair of spaced tines 46 and 48. Hook portion 34 is slidable downwardly between tines 46 and 48 upon depression of plunger 32.

Figure 2:
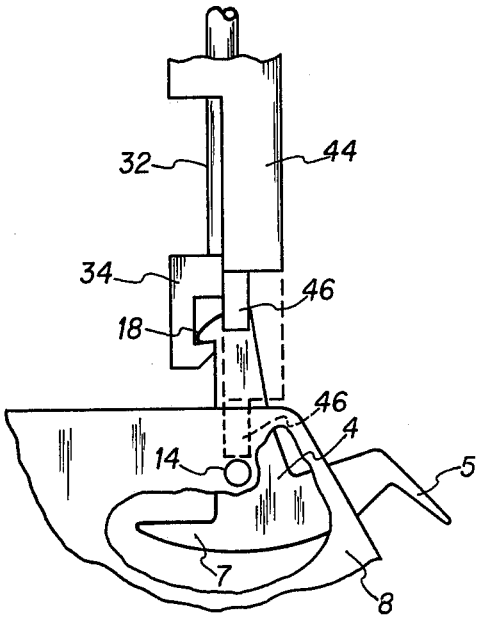
FIG. 2 is a partial side view of the tool of FIG. 1 during engagement with the latch.

In operation, plunger 32 is depressed by user engagement of top portion 42 to move hook portion 34 to its extended position, FIG. 2, to engage latch 4 at lip 18. Tool body 30 and fork portion 44 are then moved downwardly such that tines 46 and 48 enter channels 20 and 22, as shown in dashed line in FIG. 2. Tines 46 and 48 have outer tapered camming surfaces, FIG. 3, and spread the channel walls as the tines are pushed further toward apertures 23 and 24, to thus force the channel walls apart and spread the snap-in socket 6. As seen in FIG. 3, this spreading of the channel walls and socket enables clearance of trunnions 14 and 16 past the inner wall lips of apertures 23 and 24, which allows latch 4 to be removed from connector housing 8 when tool 2 is withdrawn, since hook portion 34 is engaging latch 4 at lip 18, FIG. 2.

It is thus seen that the extraction tool comprises a tool body 30 having a fork-like portion 44 insertable into socket 6 in the connector housing 8 for spreading the socket, and having an extendable hook portion 34 for engaging and removing latch 4 from connector housing 8 upon spreading of the socket. Hook portion 34 has a retracted position along the tool body, as shown in FIG. 1, and is extendable between tines 46 and 48 to an extended position beyond the tines, FIG. 2. Hook portion 34 engages latch 4 in the former's extended position prior to insertion of tines 46 and 48 into the socket in connector housing 8. The tines slide downwardly into the socket while hook portion 34 and latch 4 slide upwardly between tines 46 and 48, the socket being spread by the tines to enable removal of latch 4 by hook portion 34.

It is recognized that various modifications are possible within the scope of the appended claims.

I claim:

1. An extraction tool for removing a locking latch from between a pair of channel walls, said latch being pivoted on opposing trunnions inserted in apetures in said walls forming a snap-in socket of an electrical connector housing, said tool comprising:

a tool body;

a fork-like portion at the end of said tool body having a pair of spaced tines with outer tapered camming surfaces insertable between said channel walls toward said apertures to force said channel walls apart and spread said socket beyond the furthermost projection of said trunnions; and a spring loaded hook extendable along said tool body between said tines to an extended position for engaging and pulling said latch, upon spreading of said socket, to a position such that upon withdrawal of said fork-like portion, said trunnions do not reinsert in said apertures, thereby permitting removal of said latch.

* * * * *